US006838605B2

(12) United States Patent
Belli

(10) Patent No.: US 6,838,605 B2
(45) Date of Patent: Jan. 4, 2005

(54) DRUMSHELL LAMINATE

(75) Inventor: Remo D. Belli, Sherman Oaks, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 10/122,171

(22) Filed: Apr. 15, 2002

(65) Prior Publication Data

US 2003/0192422 A1 Oct. 16, 2003

(51) Int. Cl.[7] ..... G10D 13/02
(52) U.S. Cl. ..... 84/411 R; 84/418; 84/416
(58) Field of Search ..... 84/411 R, 418, 84/416, 419, 420

(56) References Cited

U.S. PATENT DOCUMENTS 4,045,264 A * 8/1977 Ludwig et al. ..... 156/63
4,805,513 A * 2/1989 Ito et al. ..... 84/402
5,330,848 A * 7/1994 Kluczynski et al. ..... 428/537.1
5,723,801 A * 3/1998 Hewitt ..... 84/411 R
6,291,752 B1 * 9/2001 Vergara ..... 84/411 R
2003/0029301 A1 * 2/2003 Belli ..... 84/411 R

* cited by examiner

*Primary Examiner*—Shih-yung Hsieh
(74) *Attorney, Agent, or Firm*—Rapkin, Gitlin & Beaumont

(57) ABSTRACT

An improved drumshell construction comprising a first layer of sheet material having elastic properties, a second layer of sheet material in mating engagement with the first layer of sheet material, a means to bond the two layers together, wherein the elastic modules of the first layer of material is imparted to the second layer of material to enhance the formation of a drumshell having varying sound absorptive and radiating characteristics to control and enhance the timbre of the drumhead.

8 Claims, 3 Drawing Sheets

DRUMSHELL LAMINATE

BACKGROUND OF THE INVENTION

1. Field of the Invention

The present invention relates to musical drums and, more particularly, to an improved construction of a drumshell, and a process of producing a drumshell.

2. Description of the Prior Art

The quality and intensity of sounds produced by a musical drum derive from two principal components, namely the drumhead and the drumshell. The drumhead contributes to the instrument's sound characteristics when struck by an object, such as a drumstick, mallet or the like. The composition of the material used to construct the head, and the material's thickness, combine to produce a distinct sound. Various blends of synthetic plastic and fabric materials are normally employed to produce known sound characteristics. But no distinct sound can ever be realized until the head is actually struck and caused to vibrate.

Although the shell is also caused to vibrate whenever the head is struck, not a great deal of attention has been paid to this otherwise critical component in terms of its significant contribution to the instrument's harmonics. Since the shell is a vibrating medium, similar in certain respects to the head, and vibrations affect the drum's sound characteristics, it follows that the composition of the shell component is an extremely important consideration.

The drumshell determines the timbre, or quality, of the tone produced by the head. Timbre relates to the harmonics, whose relative intensities are determined by the amount of sound that the drumshell absorbs and radiates. Prior art drumshells are comprised of a variety of materials, including, for example, wood (solid or laminate), fibreglass and carbon-graphite. In some cases, these materials are blended to create a hybrid sound. However, none of these materials, either alone or in combination, are as cost effective to manufacture and have been capable of producing the wide range of intense and quality sounds as the drumshell composition of the present invention. More specifically, the combination of components that comprise the present invention are capable, in contrast to prior art drumshells, of producing vastly improved sound characteristics for use in a wide range of applications, including without limitation, orchestral, marching band, jazz, rock and ethnic percussion environments.

The present invention also includes an improved process for producing the drumshell.

SUMMARY OF THE INVENTION

In its preferred embodiment, the present invention provides an improved drumshell construction comprising a first layer of sheet material having elastic properties, a second layer of sheet material joined in mating engagement with the first layer of sheet material, a means to bond the two layers together, wherein the elastic modulus of the first layer of material is imparted to the second layer of material to enable and facilitate the formation of a drumshell having varying and improved sound absorptive and radiating characteristics to control and enhance the timbre of the drumhead.

The first layer of sheet material can be comprised of a variety of materials, though polyester film is preferable. The second layer of sheet material also can be comprised of a variety of materials, including, for example, rigid phenol, epoxy based resin fiber board and wood veneer. Suitable adhesives or adhesive webbings are applied to bond the layers.

The present invention also includes a process for producing the drumshell. The process comprises a method of manufacturing the drumshell of the present invention that includes the steps of interposing the adhesive material between the layers of sheet materials, subjecting the bonded layers to heat, compressing the heated bonded layers until the materials become fused in a permanently compressed state, forming the fused heated materials into the shape of a drumshell and permitting the drumshell to cool while in a permanently compressed state.

Accordingly, it is an object of the present invention to provide an improved construction of a drumshell.

It is also an object of the present invention to provide an improved method of producing the drumshell.

It is another object of the present invention to provide a drumshell with specific and unique sound characteristics for use in concert with an orchestra and marching band, with a conventional drum set for playing a variety of types of music and in conjunction with ethnic percussion.

It is another object of the present invention to provide a drumshell with enhanced strength and overall flexibility enabling it to vibrate more freely and withstand impact.

It is yet another object of the present invention to provide a drumshell constructed of a bonded laminate wherein a component of the laminate contains elastic properties.

It is yet another object of the present invention to provide a drumshell constructed of a bonded laminate wherein the elastic modulus of one or more components of the laminate is imparted to certain other components to enable and facilitate the formation of the improved drumshell.

It is yet another object of the present invention to provide an improved drumshell having greatly enhanced and varying sound absorptive and radiating characteristics to better control and enhance the timbre of the drumhead.

It is yet another object of the present invention to provide an improved drumshell that is easy and cost effective to manufacture.

Other objects and advantages of the present invention will become apparent in the following specifications when considered in light of the attached drawings wherein a preferred embodiment of the invention is illustrated.

DETAILED DESCRIPTION OF THE PREFERRED EMBODIMENT

Figure 1:
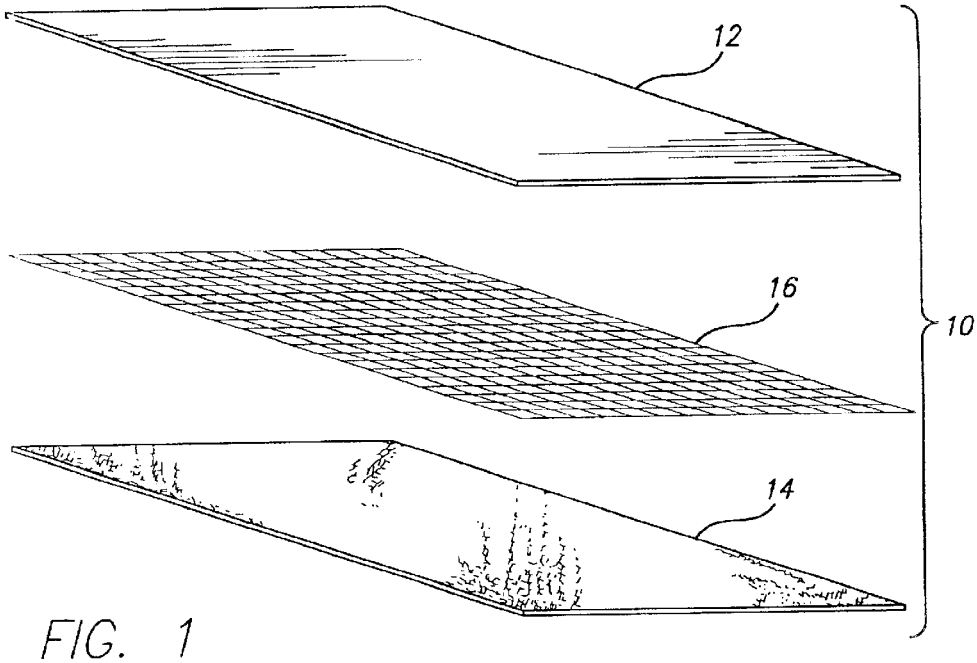
FIG. 1 is an exploded view of the present invention showing components of a laminate structure used to form a drumshell.
Figure 2:
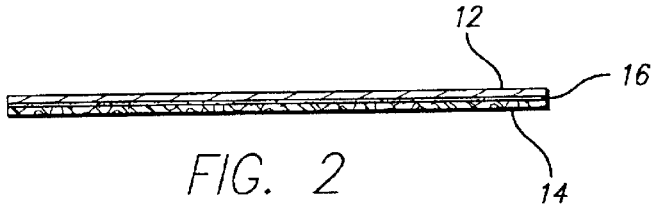
FIG. 2 is a cross-sectional view of the laminated form of the present invention shown in FIG. 1.

Referring more particularly to the drawings, FIG. 1 is a perspective view of the present invention depicting the components of the laminate structure 10 prior to their being heated and compressed to form a drumshell. Laminate structure 10 is a composite comprised of a first layer of sheet material 12, a second layer of sheet material 14, with a layer of adhesive material 16 in between sheet materials 12 and 14 to securely bond sheet materials 12 and 14.

Sheet material 12 possesses elastic properties, which are imparted to sheet material 14 when the two sheets are joined and bonded to enable the laminate structure 10 to be more flexible in forming the laminate structure 10 into a cylindrical shaped drumshell 18. Sheet material 12 is preferably comprised of a synthetic composition, including, without limitation, polyester film and similar types of materials. Sheet material 14 may also be comprised of a variety of materials, including, without limitation, rigid phenol, epoxy based resin fiberboard and wood veneer. Material 16, which is used to bond sheet materials 12 and 14, is comprised of any suitable adhesive such as, for example, an adhesive web.

Figure 3:
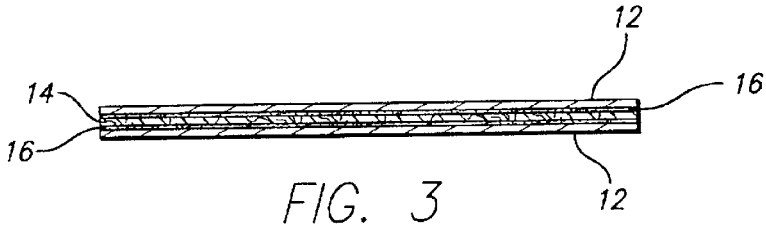
FIG. 3 is a cross-sectional view of the present invention showing multiple layers employed to form the laminate.

Depending on the needs of the user or the special requirements of the instrument, laminate structure 10 maybe comprised of multiple layers, as shown in FIG. 3. The number and composition of the layers will provide varying sound adsorptive and radiating characteristics necessary to control and enhance the timbre of the drumhead 20. The different blends of these layers and their varying thicknesses can be combined to produce numerous and very distinctive sounds. These vastly improved sounds and sound characteristics are useful in a wide range of applications, including, without limitation, orchestral, marching band, jazz, rock and ethnic percussion environments.

Figure 4A:
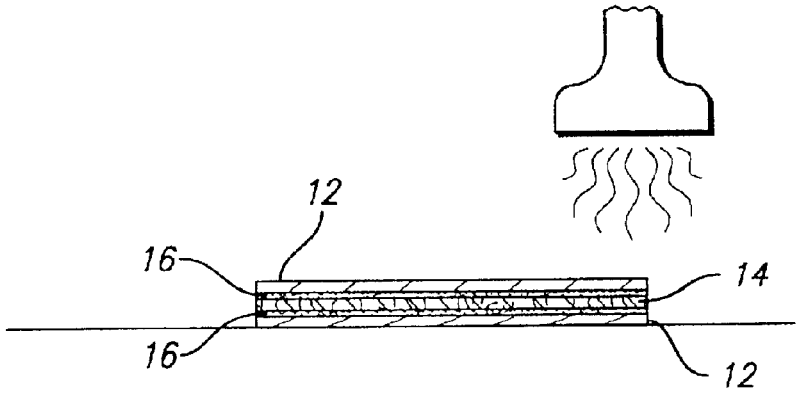
FIG. 4 is an elevational cross sectional view illustrating the steps in the manufacture of one type of laminate structure made in accordance with the present invention.
Figure 4B:
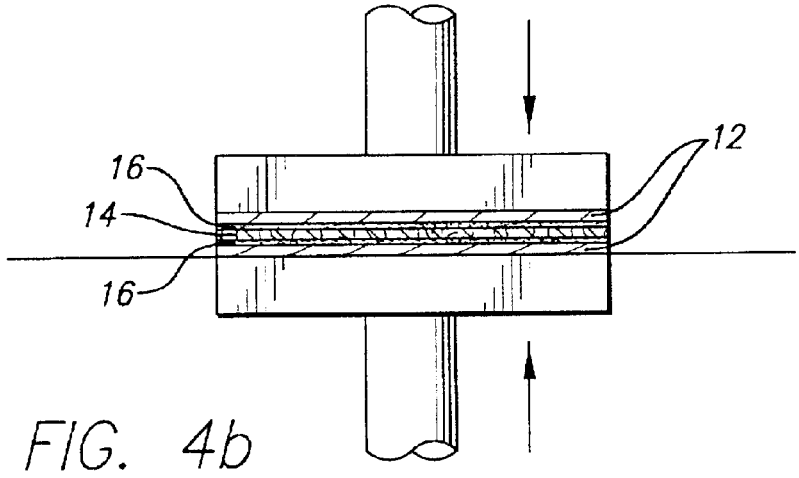
Figure 4C:
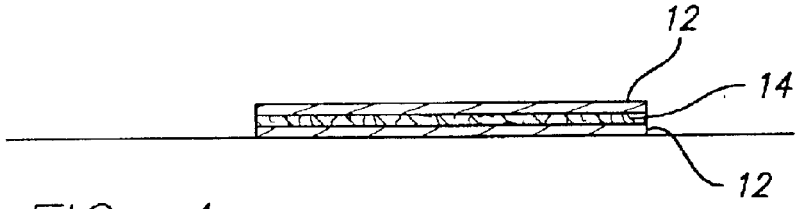
Figure 5:
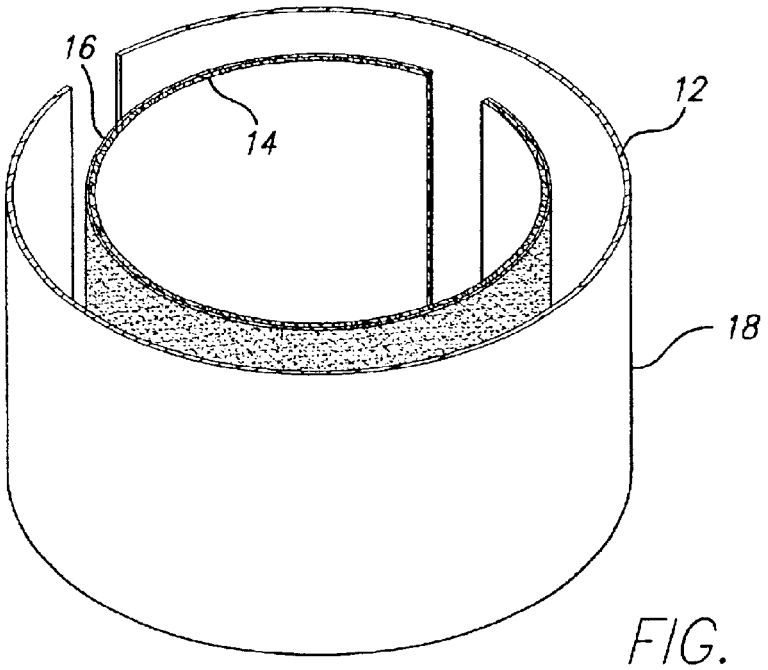
FIG. 5 is a perspective view of a laminate made in accordance with the present invention illustrating a step in the process of forming a drumshell.
Figure 6:
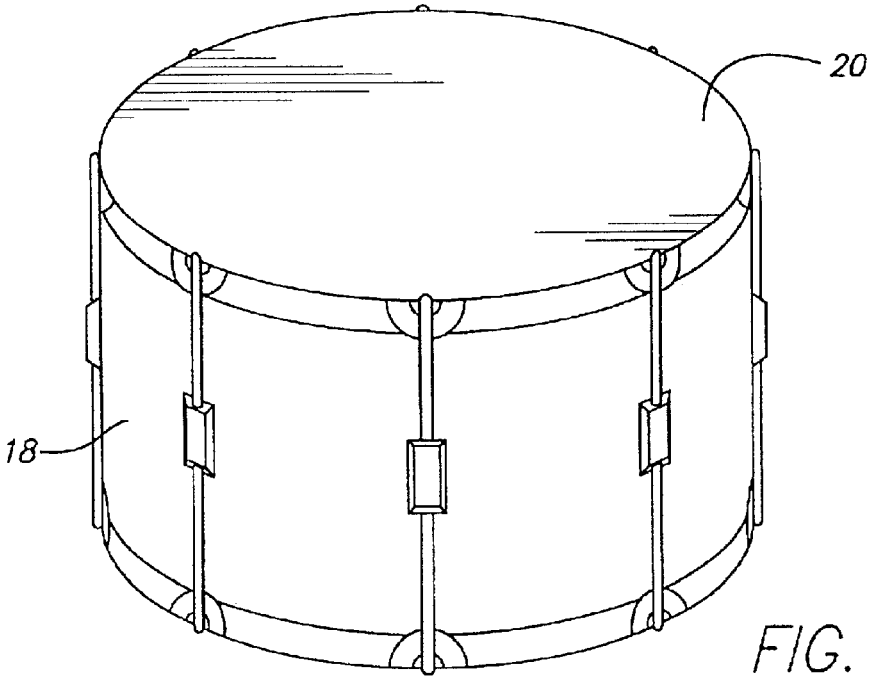
FIG. 6 is a perspective view of a finished musical drum incorporating a drumshell formed from a laminate made in accordance with the present invention.

The present invention also includes the process depicted in FIG. 4 for producing drumshell 18 comprising the steps of interposing adhesive material 16 between layers of sheet materials 12 and 14, subjecting the bonded layers of sheet materials 12 and 14 to heat (FIG. 4*a*), compressing the heated bonded layers of sheet materials 12 and 14 until the layers of materials are joined in a permanently compressed state (FIGS. 4*b* and 4*c*), forming the fused heated materials into the shape of drumshell 18 (FIG. 5) and permitting the drumshell 18 to cool while in a permanently compressed state (not shown). The process can be employed utilizing a plurality of layers of materials in different combinations depending upon the intended musical application of the drum.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A musical drum having a drumhead, and a drumshell constructed of a composite laminate, comprising:

a first single layer of sheet material, said first single layer of sheet material having elastic properties;

a second single layer of sheet material joined in mating engagement with said first single layer of sheet material, said first single layer of sheet material and said second single layer of sheet material having different material compositions;

A means to bond said first single layer of sheet material and said second single layer of sheet material such that there is an absence of any discernable open spaces between said first single layer of sheet material and said second single layer of sheet material and the elastic modulus of said first single layer of sheet material is imparted to said second single layer of sheet material to enable said composite laminate more flexibility in forming said composite laminate into a drumshell and to provide varying sound absorptive and radiating characteristics to improve the control over and enhance the timbre of said drumhead.

2. The musical drum of claim 1 wherein said first single layer of sheet material comprises a polyester film.

3. The musical drum of claim 1 wherein said second single layer of sheet material comprises a sheet of rigid phenol.

4. The musical drum of claim 1 wherein said second single layer of sheet material comprises an epoxy based resin fiber board.

5. The musical drum of claim 1 wherein said second single layer of sheet material comprises a wood veneer.

6. The musical drum of claim 1 wherein said means to bond comprises an adhesive material.

7. The musical drum of claim 1 wherein said means to bond comprises an adhesive web.

8. A musical drum having a drumhead, and a drumshell constructed of a composite laminate, comprising:

one or more single layers of polyester sheet material, each of said single layers of polyester sheet materials having elastic properties;

one or more single layers of a second sheet material, each of said single layers of second sheet material being made of a material other than polyester, bonded in mating engagement with one or more single layers of polyester sheet material; and, means to bond one or more single layers of said polyester sheet material and one or more single layers of said second sheet material such that the elastic modulus of said one or more said single layers of said polyester sheet material is imparted to one or more said single layers of said second sheet material to enable said composite laminate more flexibility in forming said composite laminate into a drumshell and to provide varying sound absorptive and radiating characteristics to improve the control over and enhance the timbre of said drumhead.

* * * * *